US010661592B2

(12) United States Patent
Lucio

(10) Patent No.: US 10,661,592 B2
(45) Date of Patent: May 26, 2020

(54) ADJUSTABLE LIGHTED BOOKMARK

(71) Applicant: Francisco Lucio, Muncie, IN (US)

(72) Inventor: Francisco Lucio, Muncie, IN (US)

( * ) Notice: Subject to any disclaimer, the term of this patent is extended or adjusted under 35 U.S.C. 154(b) by 0 days.

(21) Appl. No.: 16/381,127

(22) Filed: Apr. 11, 2019

(65) Prior Publication Data

US 2019/0232707 A1 Aug. 1, 2019

Related U.S. Application Data

(63) Continuation-in-part of application No. 29/682,225, filed on Mar. 4, 2019.

(60) Provisional application No. 62/687,412, filed on Jun. 20, 2018.

(51) Int. Cl.

| | |
|---|---|
| ***B42D 9/00*** | (2006.01) |
| ***F21V 21/22*** | (2006.01) |
| ***F21V 33/00*** | (2006.01) |
| ***F21V 23/04*** | (2006.01) |
| ***F21V 23/06*** | (2006.01) |
| ***F21V 21/088*** | (2006.01) |
| ***F21V 21/32*** | (2006.01) |
| *F21W 131/30* | (2006.01) |

(52) U.S. Cl.

CPC ..... *B42D 9/005* (2013.01); *F21V 21/088* (2013.01); *F21V 21/22* (2013.01); *F21V 21/32* (2013.01); *F21V 23/04* (2013.01); *F21V 23/06* (2013.01); *F21V 33/0048* (2013.01); *F21W 2131/3005* (2013.01)

(58) Field of Classification Search

CPC ..... B42D 9/005; F21V 21/22; F21V 23/04; F21V 23/06; F21V 33/0048; F21W 2131/3005

See application file for complete search history.

(56) References Cited

U.S. PATENT DOCUMENTS

| | | | | |
|---|---|---|---|---|
| 1,570,973 A * | 1/1926 | Simonelli | A47B 23/043 | 248/449 |
| 2,019,581 A * | 11/1935 | Probst | A47B 23/04 | 248/447 |
| 4,323,214 A * | 4/1982 | DeLuca | A47B 23/043 | 248/452 |
| 5,016,852 A * | 5/1991 | Herendeen | A47B 23/02 | 248/447.2 |
| 5,176,438 A * | 1/1993 | Fisherman | A47B 23/06 | 362/198 |
| 5,280,416 A | 1/1994 | Hartley et al. | | |

(Continued)

*Primary Examiner* — Anita M King

(74) *Attorney, Agent, or Firm* — Daniel Boudwin; Boudwin Intellectual Property Law, LLC

(57) ABSTRACT

An adjustable lighted bookmark. The adjustable lighted bookmark has a spine with an upper end opposite a lower end. A pair of upper arms, hingedly secured to the upper end of the spine, and a pair of lower arms, hingedly secured to the lower end of the spine, define a space therebetween. A pair of upper clips are disposed distally on the pair of upper arms and a pair of lower clips are disposed distally on the pair of lower arms. The pair of upper clips and the pair of lower clips are oriented inwardly towards the space between the upper and the lower arms. Each clip of the pair of upper clips and the pair of lower clips has at least one bearing on an internal surface thereof. A light extends from the spine which provides lighting on a piece of reading material secured by the adjustable lighted bookmark.

11 Claims, 3 Drawing Sheets

(56) References Cited

U.S. PATENT DOCUMENTS

| | | | | |
|---|---|---|---|---|
| 5,442,528 | A | 8/1995 | Vandenbelt | |
| 5,695,271 | A | 12/1997 | Zeller | |
| 5,979,940 | A * | 11/1999 | Araghi | A47B 23/06 248/441.1 |
| 6,302,366 | B1 * | 10/2001 | Saylor | B42F 1/006 24/489 |
| 7,163,306 | B1 | 1/2007 | Major et al. | |
| 7,510,215 | B2 * | 3/2009 | Lee | A45F 5/12 248/451 |
| 8,162,281 | B2 * | 4/2012 | Logue | A47B 97/08 248/447 |
| 9,055,816 | B2 * | 6/2015 | Panno, Jr. | A47B 97/08 |
| 10,098,452 | B2 * | 10/2018 | Ko | A47B 23/04 |
| 2006/0072328 | A1 | 4/2006 | Chan | |

* cited by examiner

ADJUSTABLE LIGHTED BOOKMARK

CROSS REFERENCE TO RELATED APPLICATIONS

This application claims the benefit of U.S. Provisional Application No. 62/687,412 filed on Jun. 20, 2018. This application also claims the benefit of U.S. Nonprovisional Application No. 29/682,225 filed on Mar. 4, 2019. The above identified patent applications are herein incorporated by reference in their entirety to provide continuity of disclosure.

BACKGROUND OF THE INVENTION

The present invention relates to bookmarks. More particularly, the present invention provides for an adjustable lighted bookmark that includes a telescoping spine, upper and a lower pair of telescoping arms, a light, and clips which include bearings disposed on the distal ends of the upper and lower pairs of telescoping arms.

Many people enjoy curling up with a good book, but few have the time to read all the way through in one sitting, especially at night. On occasion a person may fall asleep while reading and the book will fall off their lap, resulting in their place being lost. Readers often use a bookmark to keep track of their progress such that they can pick up where they left off later. Unfortunately, bookmarks may slide out of the book leaving the reader to wonder where they had left off when they return to read more. In such circumstances, some individuals may choose to start over in the book, especially if an extended period of time has passed between readings. Sometimes, casually moving a book from one place to another, such as to a bookshelf, can be sufficient to cause the bookmark to become dislodged and fall out.

Devices have been disclosed in the known art that relate to bookmarks. These include devices that have been patented and disclosed in patent application publications. However, the devices in the known art have several drawbacks. Some bookmarks easily slide out of the book, thereby losing the reader's place. Other bookmarks do not have lights incorporated therein. Still other bookmarks hold the book open at a certain page, but do not allow for the pages to be turned.

The present invention substantially diverges in design elements from the known art and consequently it is clear that there is a need in the art for an improvement to existing bookmark devices. In this regard the present invention substantially fulfills these needs. Accordingly, an adjustable bookmark, that is secured to the book and incorporates bearings that allow pages to be turned, and a light to provide improved lighting to the pages, is desired.

SUMMARY OF THE INVENTION

In view of the foregoing disadvantages inherent in the known types of bookmarks now present in the prior art, the present invention provides an adjustable bookmark that incorporates bearings that allow pages to be turned and a light to provide improved lighting to the pages. The present lighted bookmark comprises a spine with an upper end opposite a lower end. A pair of upper arms, hingedly secured to the upper end of the spine, and a pair of lower arms, hingedly secured to the lower end of the spine, define a space therebetween. A pair of upper clips are disposed distally on the pair of upper arms and a pair of lower clips are disposed distally on the pair of lower arms. The pair of upper clips and the pair of lower clips are oriented inwardly towards the space between the upper and the lower arms. Each clip of the pair of upper clips and the pair of lower clips has at least one bearing on an internal surface thereof. A light extends from the spine which provides lighting on a piece of reading material secured by the adjustable lighted bookmark.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
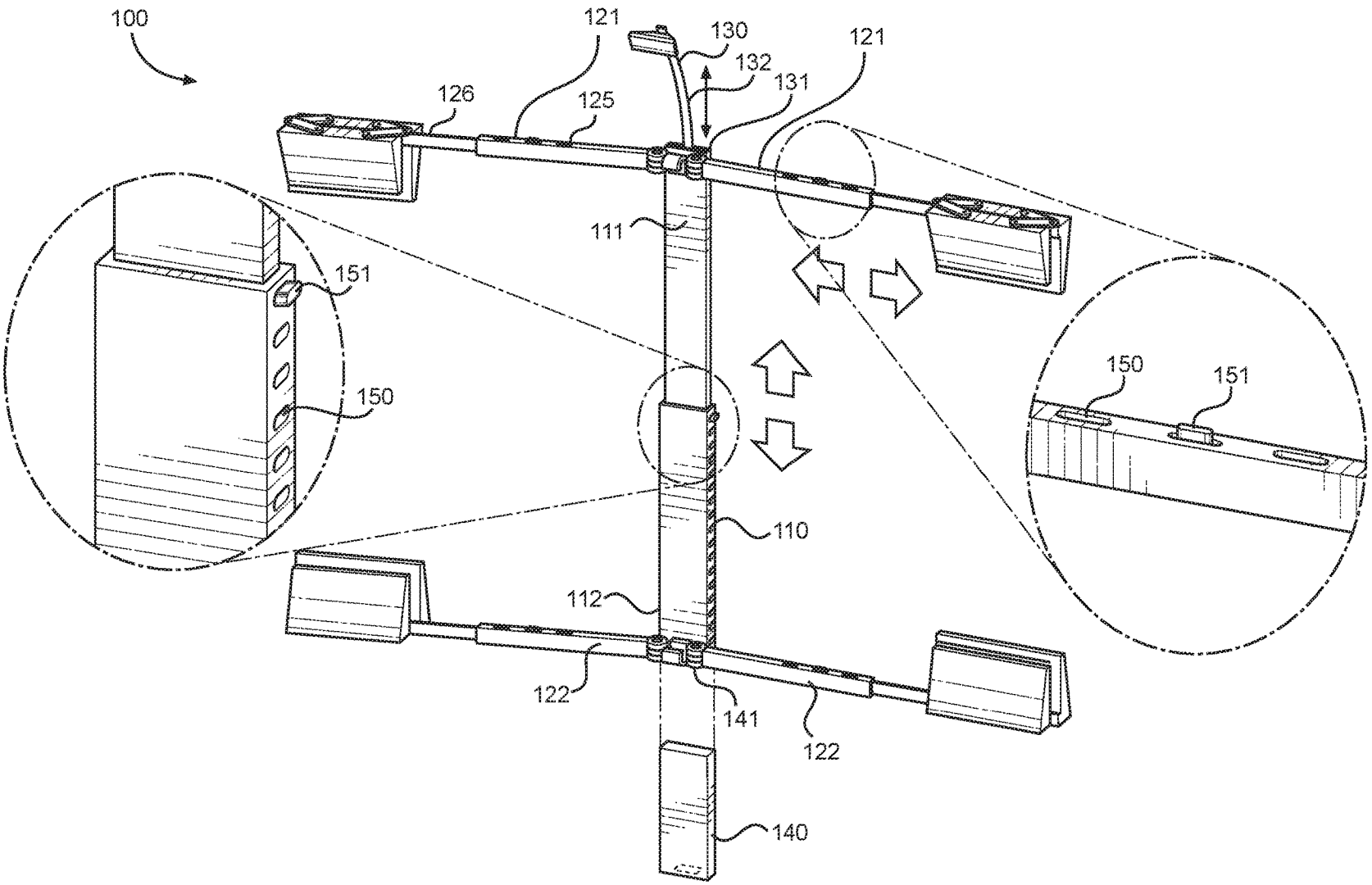
FIG. 1 shows a perspective view of an embodiment of the adjustable lighted bookmark.

Reference is made herein to the attached drawings. Like reference numerals are used throughout the drawings to depict like or similar elements of the adjustable lighted bookmark. For the purposes of presenting a brief and clear description of the present invention, a preferred embodiment will be discussed as used for the adjustable lighted bookmark. The figures are intended for representative purposes only and should not be considered to be limiting in any respect.

Referring now to FIG. 1, there is shown a perspective view of an embodiment of the adjustable lighted bookmark. The adjustable lighted bookmark 100 has a spine 110 with an upper end 111 opposite of a lower end 112. The spine 110 of the adjustable lighted bookmark 100 is telescopic, thereby allowing a user to adjust the length of the spine 110. In the shown embodiment, the upper end 111 of the spine 110 is a separate member than the lower end 112 of the spine 110. In this embodiment, the lower end 112 of the spine 110 is hollow and defines an internal space. The internal space is sized to receive the upper end 111 of the spine 110. In such an embodiment, the telescopic nature of the spine 110 is accomplished via a plurality of apertures 150 disposed along a length of the lower end 112 of the spine 110 and a complementary protrusion 151 disposed on a bottom portion of the upperend 111 of the spine 110. The complementary protrusion 151 is sized and shaped to pass through one of the plurality of apertures 150, and in such a way, lock the spine 110 into a given length. Such a manner of adjusting the length of the spine 110 allows a user of the adjustable lighted bookmark 100 to size the adjustable lighted bookmark 100 to at least the height of a chosen book, magazine, or similar piece of reading material.

A pair of upper arms 121 and a pair of lower arms 122 are hingedly secured to the spine 110; the pair of upper arms 121 are hingedly secured to the upper end 111 of the spine 110 and the pair of lower arms 122 are hingedly secured to the lower end 112 of the spine. Each arm of the pair of upper arms 121 and lower arms 122 are telescopic, thereby allowing a user to adjust the length of each arm independently of the other arms. In this manner, a user to adjust the length of each arm to correspond to the width of the piece of reading material when the piece of reading material is in an open configuration. In the shown embodiment, each arm comprises a medial end 125 and a distal end 126. The medial end 125 of a given arm is a separate member than the distal end 126 of that arm. In the shown embodiment, the medial end 125 is hallow and defines an internal space. The internal space is sized to receive the distal end 126. In such an embodiment, the telescopic nature of the arm is accomplished via a plurality of apertures 150 disposed along a length of the medial end 125 and a complementary protrusion 151 disposed on a portion of the distal end 126. The complementary protrusion 151 is sized and shaped to pass through one of the plurality of apertures 150, in the same manner as described for the telescopic spine, above.

A light 130 extends from the spine 110. In the shown embodiment, the light 130 is retractable into the spine 110. In such an embodiment, the spine 110 comprises a receiving compartment 131 into which the light 130 can fully retract into. In one embodiment, where the light 130 is fully retracted, a top surface of the light 130 is flush with a top end of the spine. In the shown embodiment, the light 130 extends upwardly from the upper end 111 of the spine 110. In one embodiment, the light 130 is configured to illuminate when extended and turn off when retracted. In another embodiment, the light 130 further comprises a switch to selectively enable and disable the light 130. In one embodiment, the light 130 further comprises a flexible shaft 132. The flexible shaft 132 is utilized by a user when the light 130 is at least in a partially extended position in order to direct illumination onto a desired page, or a portion thereof, of the piece of reading material. In such embodiments, a user can selectively activate and deactivate the light 130 to provide increased illumination on a desired page and adjust the position of the light 130 via the flexible shaft 132 to a desired location.

A power source is in electrical communication with the light 130. In one embodiment, the power source is a battery 140. In a further embodiment, the battery 140 is a removable battery. In the shown embodiment, the spine 110 is hollow and defines a cavity 141 therein. The cavity 141 is dimensioned to receive the battery 140. In such an embodiment, a user can replace the battery 140 when the battery 140 is low or out of charge.

In a further embodiment, the spine 110 further comprises at least one USB port. In various embodiments, the USB port enables a user to attach a power cord thereto, and attach the power cord to an outside source, such as an electrical outlet, to provide a source of electricity. The USB port also enables a user to charge the power source where the power source is a rechargeable battery. The USB port further allows a user to utilize the power source to charge external devices. For example, where the power source is a battery 140, a user is able to utilize the USB port to electrically attach an external device to the battery 140. In such a manner, a user is able to recharge various electronic devices, such as cellphone or tablets, via the power source of the adjustable lighted bookmark.

Figure 2:
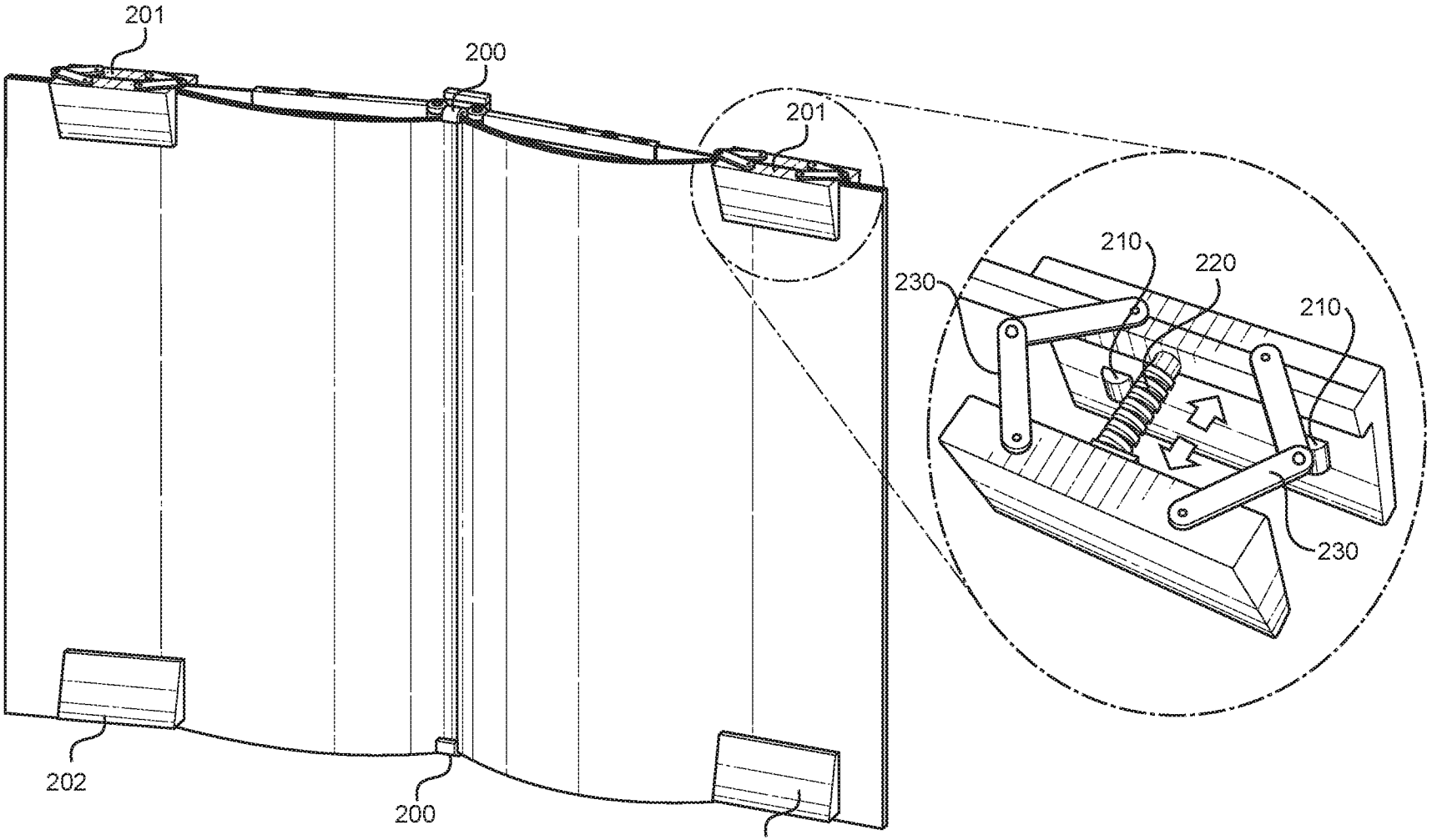
FIG. 2 shows a perspective view of an embodiment of the adjustable lighted bookmark, in use.

Referring now to FIG. 2, there is shown a perspective view of an embodiment of the adjustable lighted bookmark, in use. The pair of upper arms and the pair of lower arms define a space therebetween. A pair of upper clips 201 are disposed distally on the pair of upper arms. A pair of lower clips 202 are disposed distally on the pair of lower arms. The pair of upper clips 201 and the pair of lower clips 202 are oriented inwardly towards the space defined between the pair of upper arms and the pair of lower arms. Each of the pair of upper clips 201 and lower clips 202 are configured to removably secure to a piece of reading material such as a book. In use, a user adjusts the length of the spine to the height of the piece of reading material and adjusts the length of the upper and lower pairs of arms such that the upper clips 201 and lower clips 202 are positioned along the desired edges of the piece of reading material. In such a manner, a user can secure the piece of reading material to the adjustable lighted bookmark via the upper clips 201 and the lower clips 202.

Each clip of the pair of upper clips 201 and pair of lower clips 202 further comprises at least one bearing 210 on an internal surface thereof. In the shown embodiment, the bearings 210 are roller bearings that are shaped as a barrel. The rounded portion of the bearings 210 are configured to rest against a page of a piece of reading material and rotate in place along an axis defined by the length of the bearings 210. In such a manner, a user is able to secure a page of a piece f reading material in a clip and slide the page out of the clips via the bearings 210. In this way a user can turn the pages of the piece of reading material, sliding the page out of one clip and into another, without opening either clip. In a further embodiment, the clip further comprises a lock to disengage the bearing 210, thereby locking the clip onto pages and/or a cover of a piece of reading material. By selectively engaging the lock, a user is able to ensure that the pages and/or cover of a piece of reading material do not unintentionally slide out of the clip.

In one embodiment, each clip of the pair of upper clips 201 and pair of lower clips 202 are spring 220 biased in a closed position. In such a manner, a user can secure pages and/or a cover of a piece of reading material into the clips, as detailed above, and the spring 220 bias of the clip will hold such pages and/or cover in place. In this way, a user can secure the piece of reading material onto the adjustable lighted bookmark and the adjustable lighted bookmark will hold the pages and/or cover in place and keep the piece of reading material in an open, and readable, configuration.

In one embodiment, each clip of the pair of upper clips 201 and pair of lower clips 202 further comprises at least one bracket 230 externally disposed therein. In the shown embodiment, the brackets 230 are configured to hingedly secure both sides on an individual clip in an open and closed position. Such brackets 230 provide further support and stability to the clip and provide a user with an additional method of securing pages and/or a cover of a piece of reading material in the clip.

In another embodiment, the spine further comprises a pair of supports 200. In the shown embodiment, a pair of supports 200 are disposed on opposing ends of the spine and are configured to receive the spine of a piece of reading material. The supports 200 provide additional structure and stability, as well as additional attachment points, when securing the piece of reading material to the adjustable lighted bookmark.

Figure 3:
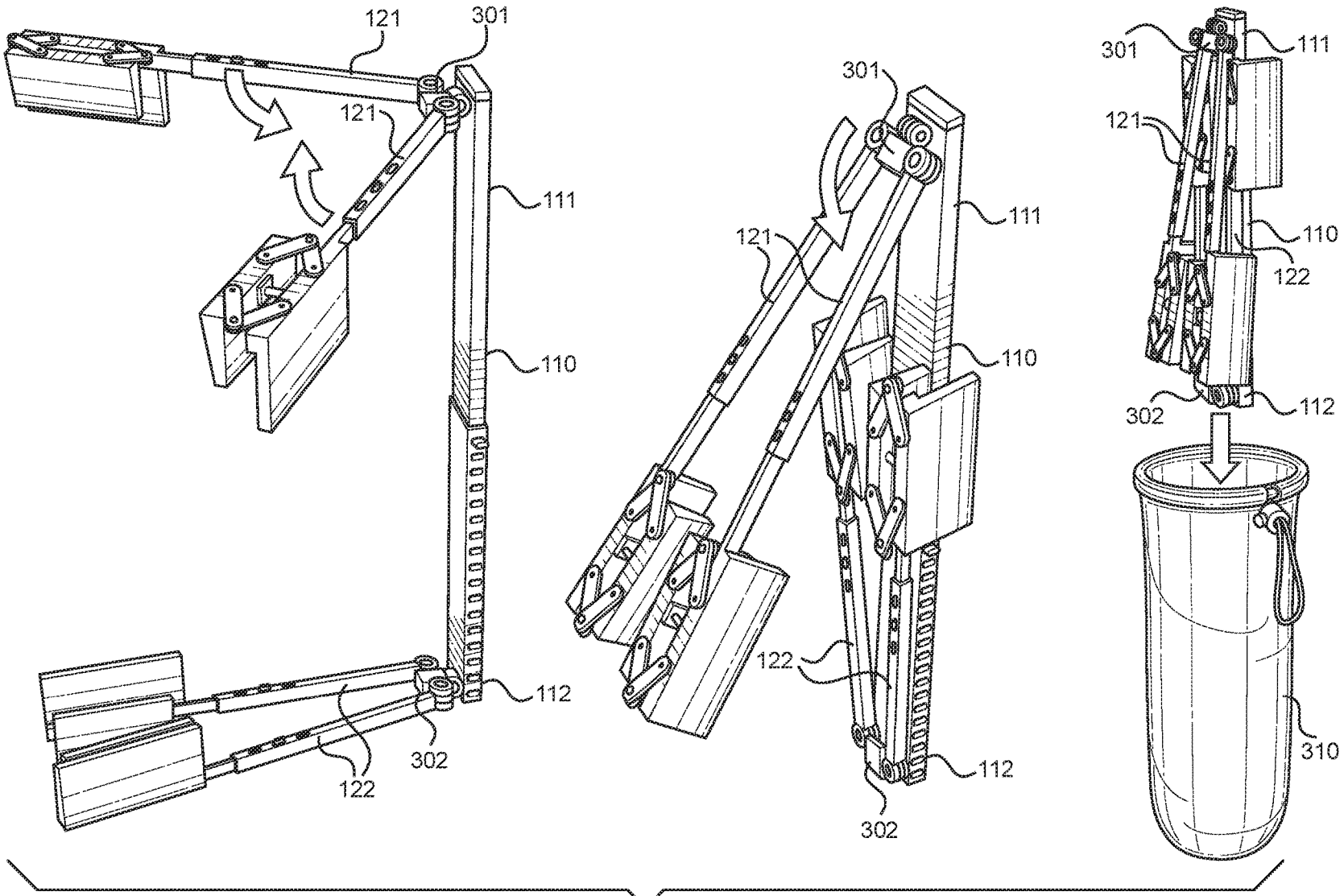
FIG. 3 shows a perspective view of an embodiment of the adjustable lighted bookmark, with a demonstration of the manner in which the adjustable lighted bookmark may be folded into a collapsed configuration.

Referring now to FIG. 3, there is shown a perspective view of an embodiment of the adjustable lighted bookmark, with a demonstration of the manner in which the adjustable lighted bookmark may be folded into a collapsed configuration. The pair of upper arms 121 are hingedly secured to an upper arm base 301 therebetween. The upper arm base 301 is hingedly affixed to the upper end 111 of the spine 110, such that the pair of upper arms 121 are foldable inwardly towards the spine 110 and downwardly towards the pair of lower arms 122. The pair of lower arms 122 are hingedly secured to a lower arm base 302 therebetween. The lower arm base 302 is hingedly affixed to the lower end 112 of the spine 110, such that the pair of lower arms 122 are foldable inwardly towards the spine 110 and upwardly towards the pair of upper arms. In such a manner, a user is able to fold the upper arms 121 and lower arms 122 along the spine into a collapsed, storage configuration. In the shown embodiment, the adjustable lighted bookmark is collapsed and stored in a carrying case 310.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable lighted bookmark, comprising:

a spine having an upper end opposite of a lower end, wherein the spine defines a cavity therein, the cavity dimensioned to receive a battery;

a pair of upper arms hingedly secured to the upper end of the spine;

a pair of lower arms hingedly secured to the lower end of the spine;

the pair of upper arms and the pair of lower arms defining a space therebetween;

a pair of upper clips disposed distally on the pair of upper arms;

a pair of lower clips disposed distally on the pair of lower arms;

wherein the pair of upper clips and the pair of lower clips are oriented inwardly towards the space;

wherein each clip of the pair of upper clips and the pair of lower clips further comprises at least one bearing on an internal surface thereof;

a light extending from the spine.

2. The adjustable lighted bookmark of claim 1, wherein the light is retractable into the spine.

3. The adjustable lighted bookmark of claim 1, wherein the light extends upwardly from the upper end of the spine.

4. The lighted bookmark of claim 1, wherein the pair of upper arms and the pair of lower arms are telescopic.

5. The adjustable lighted bookmark of claim 1, wherein the spine is telescopic.

6. The adjustable lighted bookmark of claim 1, wherein the light is configured to illuminate when extended and turn off when retracted.

7. The adjustable lighted bookmark of claim 1, wherein the spine further comprises a pair of supports.

8. The adjustable lighted bookmark of claim 1, wherein each clip of the pair of upper clips and the pair of lower clips is spring biased in a closed position.

9. The adjustable lighted bookmark of claim 1, wherein each clip of the pair of upper clips and the pair of lower clips further comprises at least one bracket externally disposed thereon.

10. The adjustable lighted bookmark of claim 1, wherein the pair of upper arms are hingedly secured to an upper arm base therebetween, the upper arm base hingedly affixed to the upper end of the spine, such that the pair of upper arms are foldable inwardly and downwardly.

11. The adjustable lighted bookmark of claim 1, wherein the pair of lower arms are hingedly secured to a lower arm base therebetween, the lower arm base hingedly affixed to the lower end of the spine, such that the pair of lower arms are foldable inwardly and upwardly.

* * * * *